US008955175B2

(12) United States Patent
Wiegmann et al.

(10) Patent No.: US 8,955,175 B2
(45) Date of Patent: Feb. 17, 2015

(54) CORNER ASSEMBLY FOR A FOLDABLE CHILD ENCLOSURE

(75) Inventors: Elijah M. Wiegmann, Pittsburgh, PA (US); Robert D. Daley, Pittsburgh, PA (US); Jared A. Rosenthal, Pittsburgh, PA (US); Henry F. Thorne, West View, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 6 days.

(21) Appl. No.: 13/610,998

(22) Filed: Sep. 12, 2012

(65) Prior Publication Data

US 2013/0240815 A1 Sep. 19, 2013

Related U.S. Application Data

(60) Provisional application No. 61/533,399, filed on Sep. 12, 2011.

(51) Int. Cl.
*A47D 9/00* (2006.01)
*A47D 13/06* (2006.01)

(52) U.S. Cl.
CPC ..... *A47D 13/061* (2013.01); *A47D 9/005* (2013.01); *A47D 13/063* (2013.01)
USPC ..... 5/99.1; 5/102; 256/25

(58) Field of Classification Search
USPC ..... 5/99.1, 98.1, 93, 93.1–102; 256/25
See application file for complete search history.

(56) References Cited

U.S. PATENT DOCUMENTS

| | | | |
|---|---|---|---|
| 4,811,437 | A | 3/1989 | Dillner et al. |
| 6,467,108 | B1 | 10/2002 | Wang |
| 6,721,971 | B1 | 4/2004 | Cheng |
| 7,958,578 | B2 | 6/2011 | Shan et al. |
| 2008/0034497 | A1 | 2/2008 | Cheng |
| 2009/0013463 | A1 | 1/2009 | Cheng |
| 2009/0172879 | A1 | 7/2009 | Hsu |

FOREIGN PATENT DOCUMENTS

KR 10-1992-0007466 B1 9/1992

*Primary Examiner* — Peter M Cuomo
*Assistant Examiner* — Brittany Wilson
(74) *Attorney, Agent, or Firm* — The Webb Law Firm

(57) ABSTRACT

A corner assembly for a foldable child enclosure includes: a corner cover attached to a side post of the foldable child enclosure; a first rail cover mating with a first opening in the corner cover and attached to a first upper arm of the foldable child enclosure; and a second rail cover mating with a second opening in the corner cover and attached to a second upper arm of the foldable child enclosure. The first rail cover and the second rail cover move relative to the corner cover as the foldable child enclosure is moved from a folded position to an open position.

20 Claims, 5 Drawing Sheets

CORNER ASSEMBLY FOR A FOLDABLE CHILD ENCLOSURE

CROSS REFERENCE TO RELATED APPLICATIONS

This application claims the benefit of U.S. Provisional Patent Application No. 61/533,399 entitled "Corner Assembly for a Foldable Child Enclosure" filed Sep. 12, 2011, which is hereby incorporated by reference in its entirety.

BACKGROUND OF THE INVENTION

1. Field of the Invention

The present invention relates generally to a foldable child enclosure, such as a play yard, playpen, or crib apparatus, and, more particularly, to a corner assembly for such a foldable child enclosure.

2. Description of Related Art

Foldable play yards, playpens, and crib devices are well-known, as perhaps best exemplified by U.S. Pat. No. 4,811,437 for a "Foldable Playyard" to Dillner et al. The foldable device disclosed therein is light in weight, and when collapsed, a fairly convenient compact package.

Such foldable play yards include corner assemblies for connecting the upper rails of the play yard and for providing a finished appearance to the play yard. In addition, conventional play yards typically include one or more latching mechanisms provided at a midpoint of the upper rails for automatically latching and securing the upper rails in a substantially in-line configuration when the play yard is in the open position.

However, if the latching mechanism is moved to the corners of the play yard, such conventional corner assemblies are not sufficient for covering the latching mechanism so that it cannot be interfered with by a user or a child positioned within the play yard.

Accordingly, a need exists for a corner assembly for a foldable child enclosure that sufficiently covers a latching mechanism provided in the corners of the foldable child enclosure, while maintaining an aesthetically appealing appearance.

SUMMARY OF THE INVENTION

An object of the present invention is to provide a corner assembly for a foldable child enclosure that sufficiently covers latching mechanisms provided in the corners of the foldable child enclosure, while maintaining an aesthetically appealing appearance.

According to one aspect of the invention, provided is a corner assembly for a foldable child enclosure that includes: a corner cover attached to a side post of the foldable child enclosure; a first rail cover mating with a first opening in the corner cover and attached to a first upper arm of the foldable child enclosure; and a second rail cover mating with a second opening in the corner cover and attached to a second upper arm of the foldable child enclosure. The first rail cover and the second rail cover are moved relative to the corner cover as the foldable child enclosure is moved from a folded position to an open position.

The corner cover may be formed from a front cover section and rear cover section attached around the side post of the foldable child enclosure. The first rail cover and the second rail cover may each be formed from a front cover and rear cover attached around the first upper arm and the second upper arm, respectively. The corner assembly may be positioned to cover a latching mechanism for locking the foldable child enclosure in the open position. A first end of the first rail cover may be formed in a substantially ball-like shape that is concentric with the first opening of the corner cover. A first end of the second rail cover may be formed in a substantially ball-like shape that is concentric with the second opening of the corner cover. The first rail cover and the second rail cover may be positioned substantially perpendicularly to one another. The first rail cover and the second rail cover may be configured to cover a latching mechanism when in the open position. A bottom portion of the corner cover may be substantially open.

According to another aspect of the invention, also provided is a foldable child enclosure that includes: an upper assembly forming an upper portion of the structure; a base assembly forming a lower portion of the structure; a post extending from each corner of the upper assembly to a corner of the base assembly, thereby forming the structure; at least one latching mechanism provided at each corner of the upper assembly extending from an upper portion of at least one of the posts to a portion of at least one of the arm assemblies; and a corner assembly provided at each corner of the upper assembly for covering the at least one latching mechanism. The corner assembly includes: a corner cover attached to a side post of the foldable child enclosure; a first rail cover mating with a first opening in the corner cover; and a second rail cover mating with a second opening in the corner cover. The first rail cover and the second rail cover move relative to the corner cover as the foldable child enclosure is moved from a folded position to an open position.

According to yet another aspect of the invention, also provided is a corner assembly for a foldable child enclosure that includes a central portion; and two side portions mating with opposed openings provided in the central portion. The corner assembly covers at least one latching mechanism provided in upper corners of the foldable child enclosure.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
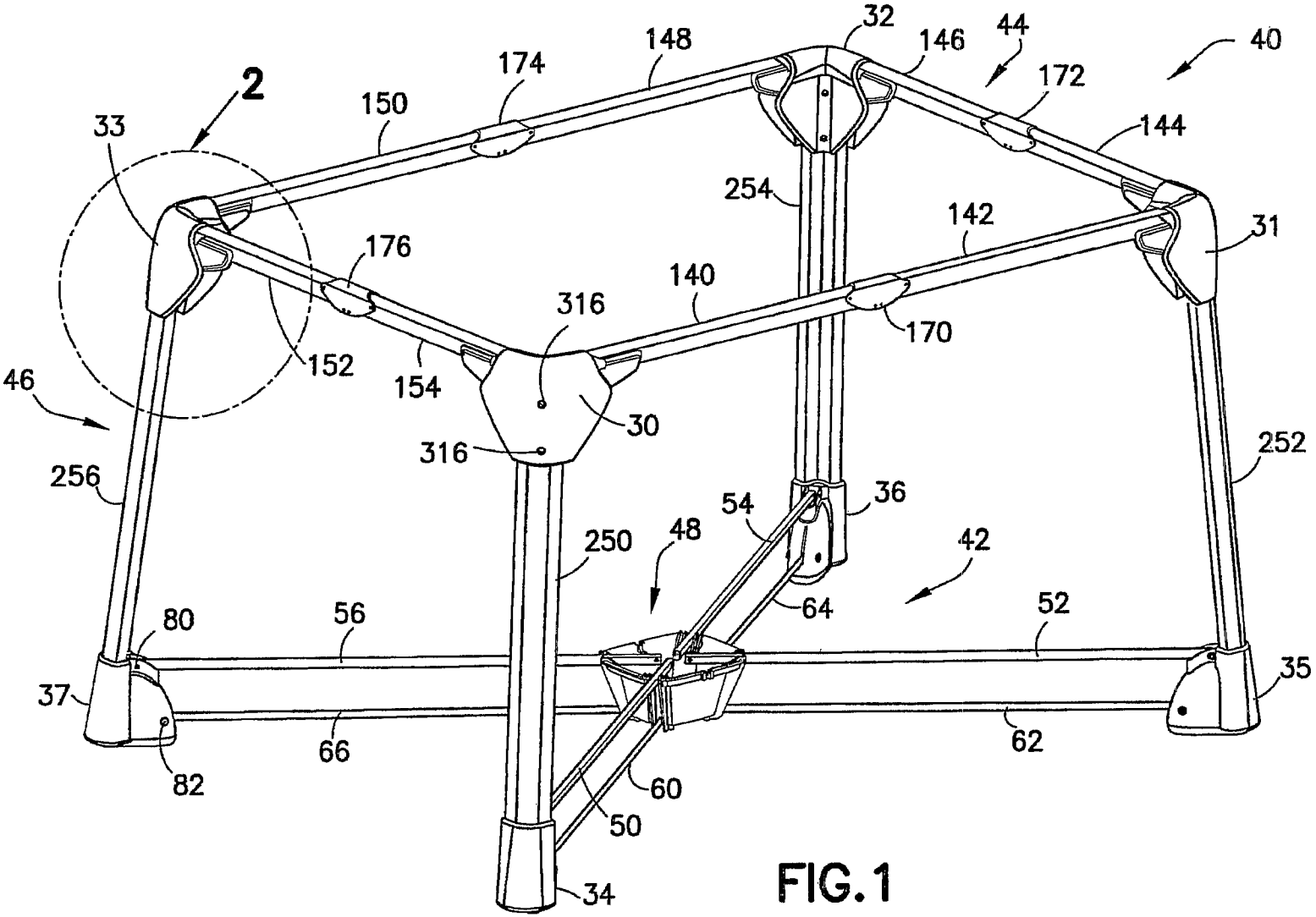
FIG. 1 is a perspective view of a frame of a play yard in an opened position in accordance with the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

With reference to FIG. 1, a foldable child enclosure apparatus configured in the form of a play yard, or playpen, is illustrated. This foldable child enclosure apparatus is discussed in greater detail in co-pending provisional Patent Application No. 61/468,168, filed Mar. 28, 2010, which is hereby incorporated by reference in its entirety. The foldable child enclosure apparatus is portable, and as such, is foldable, closable, or collapsible so as to move between an opened, deployed position for use, and a folded, collapsed, or closed position for transport and/or storage. The play yard may have soft, flexible mesh sides, fabric coverings, a base pad or mattress, and decorative and protective upper and lower corner assemblies, such as the four upper corner assemblies 30, 31, 32, 33, and the four lower corner assemblies 34, 35, 36, 37. Side padding may also be placed around the interior of the play yard for added protection of a child placed on the pad or mattress. Storage devices, child seats, bassinets, and the like may also be mounted on and to the play yard although they are not shown here. Under the mesh, the fabric, the pad, and any side padding is a foldable frame, denoted generally as reference numeral 40, as shown in an opened position in FIG. 1.

The detailed description of the foldable frame 40 set forth hereafter may best be understood by dividing the foldable frame 40 into four portions. The frame 40 includes: a base assembly, denoted generally as reference numeral 42, forming a lower portion of the frame 40; an upper assembly, denoted generally as reference numeral 44, forming an upper portion of the frame 40; a side structure, denoted generally as reference numeral 46; and a centrally-located hub assembly, denoted generally as reference numeral 48. The base assembly 42 is pivotally connected to both the hub assembly 48 and to the side structure 46, and the upper assembly 44 is pivotally connected to the side structure 46.

The base assembly 42 includes four upper base legs 50, 52, 54, 56, and four lower base legs 60, 62, 64, 66, four lower corners 34, 35, 36, 37, and pivot rivets, such as the rivets 80, 82 around which the upper base leg 50 and the lower base leg 60 pivot or rotate relative to the corner 34. The base legs are configured as shown in an "X" pattern. The upper assembly 44 includes eight upper arms 140, 142, 144, 146, 148, 150, 152, 154, the four upper corner assemblies 30, 31, 32, 33, and four stiffening members 170, 172, 174, 176.

The side structure 46 includes four generally vertically disposed side posts 250, 252, 254, 256. Each side post 250, 252, 254, 256 is connected to a respective lower corner and to a respective upper corner assembly.

Each upper corner of the foldable frame 40 includes a latching mechanism (shown partially in FIG. 2) positioned beneath the upper corner assemblies 30, 31, 32, 33. The upper corner assemblies 30, 31, 32, 33 sufficiently cover latching mechanisms provided in the corners of the foldable child enclosure, while maintaining an aesthetically appealing appearance.

With reference to FIGS. 2-5, upper corner assembly 33 is illustrated. Only upper corner assembly 33 will be detailed hereinafter because all of the other upper corner assemblies of the frame are identically configured. Upper corner assembly 33 includes: a corner cover, denoted generally as reference numeral 300, attached to side post 256 of the frame 40; a first rail cover 302 mating with a first opening 304 in the corner cover 300 and attached to upper arm 152 of the frame 40; and a second rail cover 306 mating with a second opening 308 in the corner cover 300 and attached to upper arm 150 of the frame 40. The first rail cover 302 and the second rail cover 306 are positioned substantially perpendicularly to one another. A bottom portion 309 of the corner cover 300 is substantially open to allow receipt therein of portions of the first rail cover 302, upper arm 152, second rail cover 306, and upper arm 150 when the frame is in the folded position. The use of such a three part upper corner assembly 33 allows the corner assembly to completely cover the corner latching mechanism during folding and unfolding of the foldable child enclosure while maintaining a small and aesthetically pleasing configuration.

The corner cover 300 is formed from a front cover section 310 and rear cover section 312 attached around side post 256 of the foldable child enclosure. The front cover section 310 and the rear cover section 312 of the corner cover 300 are coupled to side post 256 by a rivet, or any other suitable fastening device, that passes through holes 314 provided on rear cover section 312 (see FIG. 4), through side post 256, and secured to holes 316 provided on the front cover section 310 (see FIG. 1). The front cover section 310 and the rear cover section 312 of the corner cover 300 may be molded as one, integral piece or they may be separately molded.

The first rail cover 302 is also formed from a front cover 318 and rear cover 320 attached around upper arm 152. The first rail cover 302 has a first end 322 configured to be positioned within opening 304 and a second end 324. The second end 324 has a pair of holes 326 that are configured to receive a rivet, or any other suitable fastening device, that passes through a first hole 328 provided in upper arm 152 to secure the first rail cover 302 to upper arm 152. A second hole 330 is provided on upper arm 152 closer to the end of upper arm 152 than the first hole 328 for coupling upper arm 152 to a portion 332 of the corner latching mechanism of the frame 40. The first end 322 of the first rail cover 302 is formed in a substantially ball-like shape that is concentric with the first opening 304 of the corner cover 300. This configuration eliminates pinch points at the corner between the moving first rail cover 302 and the stationary corner cover 300 as the frame 40 is folded and unfolded. In addition, this configuration allows the first rail cover 302 to completely cover the corner latching mechanism as the frame 40 is folded and unfolded. This ball-like shape is not to be considered as limiting the present invention, as any shape in which the first end 322 of the first rail cover 302 maintains continuous contact with the edges of the first opening 304 of the corner cover 300 may be utilized.

The second rail cover 306 is also formed from a front cover 334 and rear cover 336 attached around upper arm 150. The second rail cover 306 has a first end 338 configured to be positioned within opening 308 and a second end 340. The second end 340 has a pair of holes 342 that are configured to receive a rivet, or any other suitable fastening device, that passes through a first hole 344 provided in upper arm 150 to secure the second rail cover 306 to upper arm 150. A second hole 346 is provided on upper arm 150 closer to the end of upper arm 150 than the first hole 344 for coupling upper arm 150 to a portion 348 of the corner latching mechanism of the frame 40. The first end 338 of the second rail cover 306 is formed in a substantially ball-like shape that is concentric with the second opening 308 of the corner cover 300. This configuration eliminates pinch points at the corner between the moving second rail cover 306 and the stationary corner cover 300 as the frame 40 is folded and unfolded. In addition, this configuration allows the second rail cover 306 to completely cover the corner latching mechanism as the frame 40 is folded and unfolded. This ball-like shape is not to be considered as limiting the present invention, as any shape in which the first end 338 of the second rail cover 306 maintains continuous contact with the edges of the second opening 308 of the corner cover 300 may be utilized.

Each portion of each of the upper corner assemblies 30, 31, 32, 33 is desirably injection molded from a suitable polymeric material; however, this is not to be construed as limiting the present invention as any suitable material may be utilized during the manufacture of the upper corner assemblies 30, 31, 32, 33.

Figure 2:
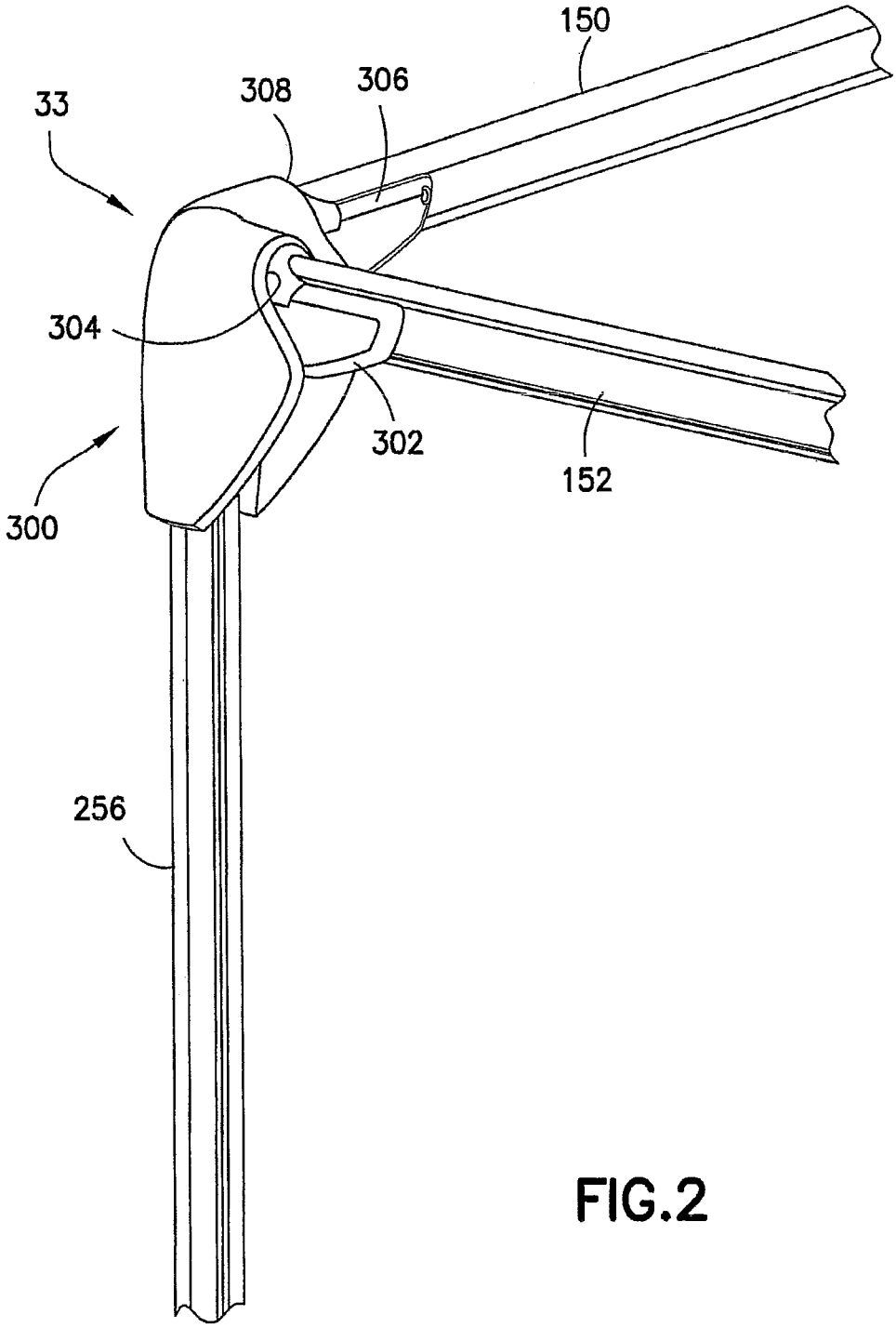
FIG. 2 is a portion of FIG. 1 enlarged for magnification purposes.
Figure 3:
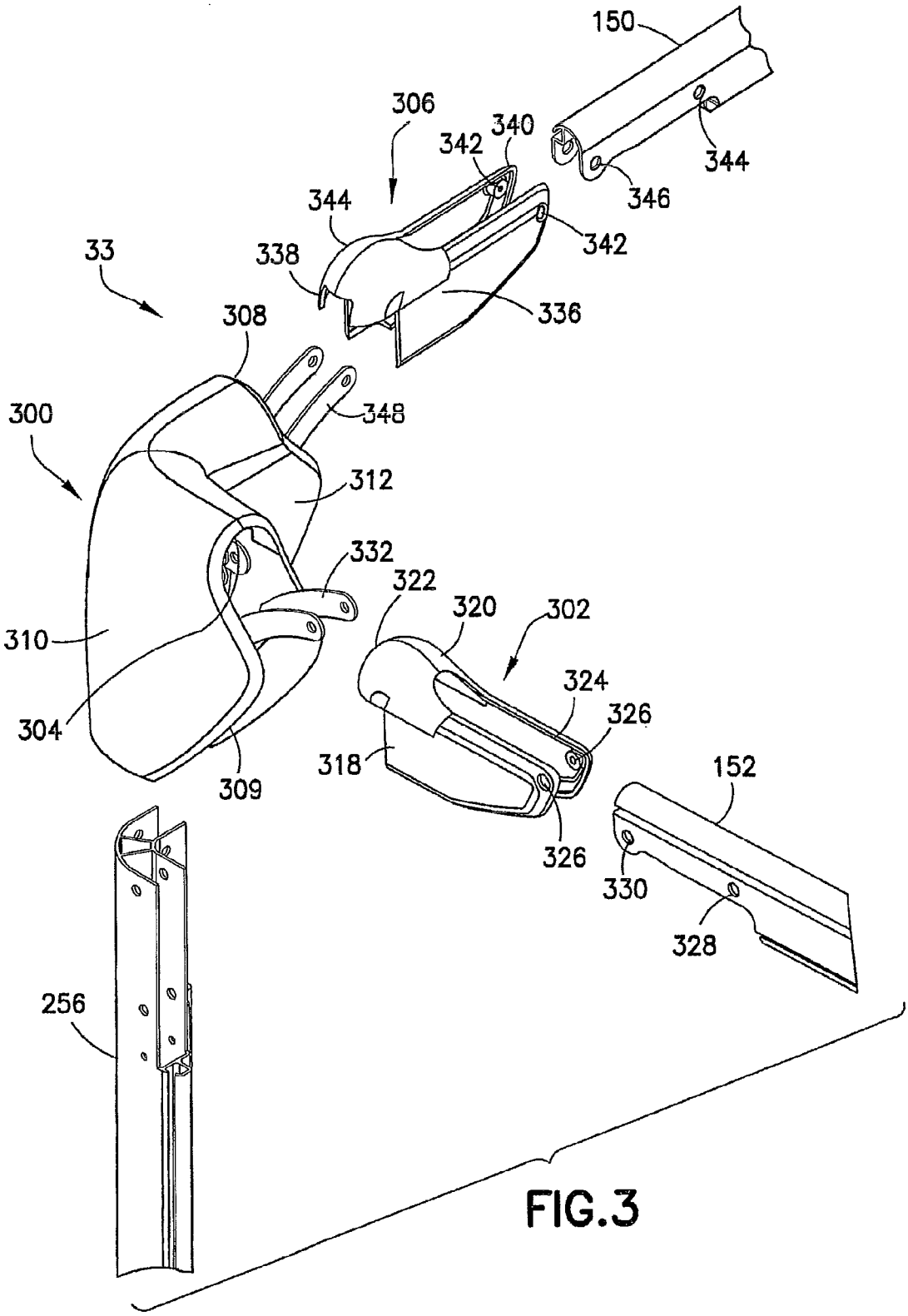
FIG. 3 is an exploded perspective view of a corner assembly in accordance with the present invention.
Figure 4:
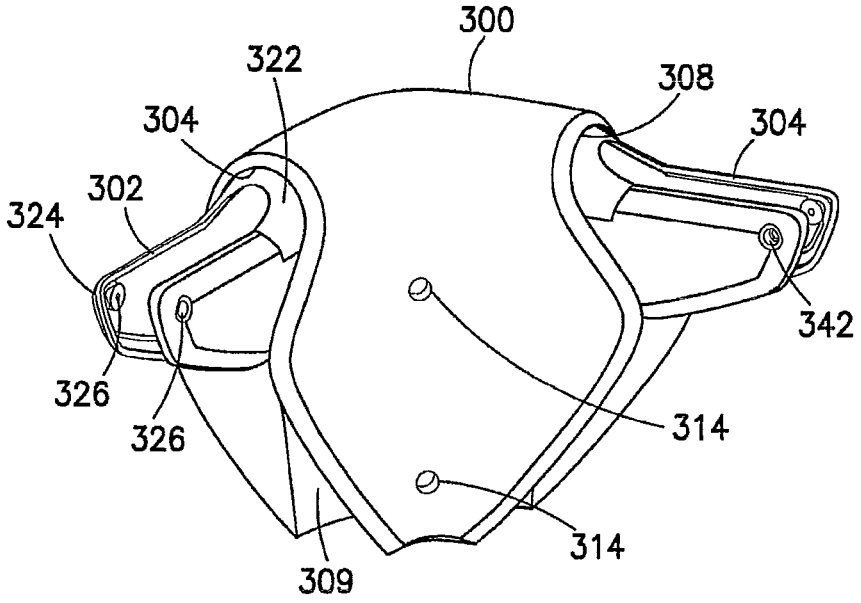
FIG. 4 is a rear perspective view of the corner assembly in accordance with the present invention.
Figure 5:
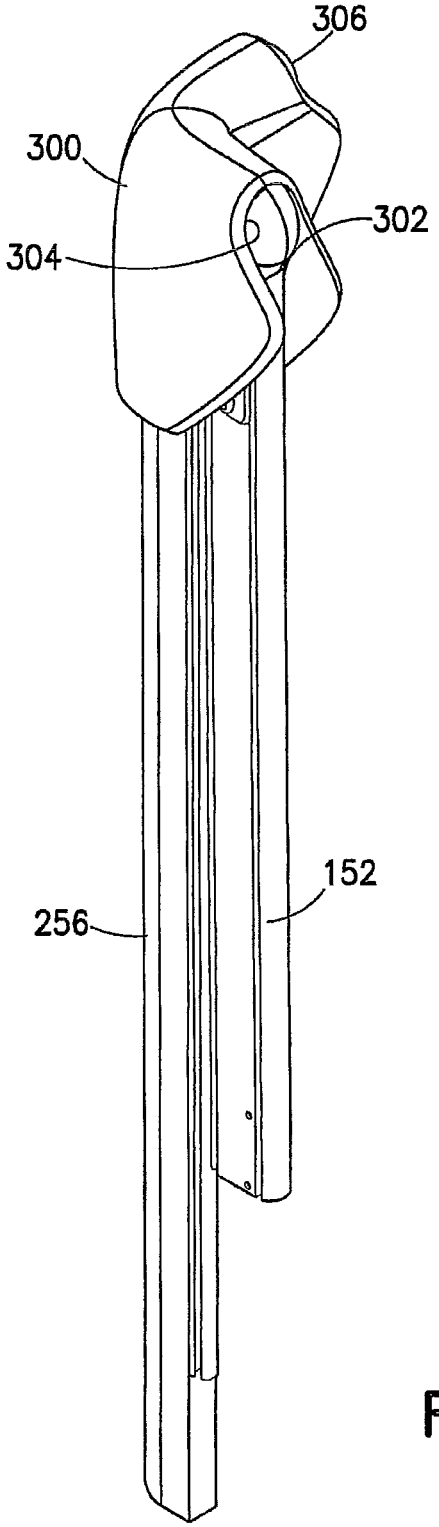
FIG. 5 is a side perspective view of the corner assembly in a folded position.

The first rail cover 302 and the second rail cover 306 move relative to the corner cover 300 as the frame 40 of the foldable child enclosure is moved from an open position as shown in FIG. 2 to a closed position as shown in FIG. 5 and are configured to cover the corner latching mechanism during the movement from the open position to the closed position and vice versa.

The remaining upper corner assemblies 30, 31, 32 are arranged in a fashion similar to upper corner assembly 33 discussed hereinabove.

As an alternative embodiment, the first and second rail covers are eliminated and steel tubing is used for the upper arms. In such an embodiment, the steel tubing of the upper arms is terminated by crushing the steel tube so that the width is less than about 5 mm. By configuring the upper arms in this manner, the need for the ball and socket joint and the first and second rail covers is eliminated. However, the corner latch mechanism would be accessible from the bottom. It is a requirement that these latch mechanisms be inaccessible from inside the child containment area. It is desirable that these latch mechanisms also be inaccessible from the outside. One proposed way to achieve this is to use soft goods including fabric, mesh, and lightweight plastic, for example, to create a pocket in which the mechanics can move freely, but cannot be accessed by the user. A second possible way to achieve this is to build the corner cover in such a way that the hard shell of the cover creates a protected environment in which the mechanics can operate with a slot of 5 mm or less for the side rails to move through. In this case, the rail covers would not be necessary.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

The invention claimed is:

1. A corner assembly for a foldable child enclosure comprising:

a corner cover attached to a side post of the foldable child enclosure;

a first rail cover having a first end that mates with a first opening in the corner cover, the first rail cover being attached to a first upper arm of the foldable child enclosure; and a second rail cover having a first end that mates with a second opening in the corner cover, the second rail cover being attached to a second upper arm of the foldable child enclosure, wherein the first rail cover and the second rail cover move relative to the corner cover as the foldable child enclosure is moved from a folded position to an open position such that at least a portion of the first end of the first rail cover maintains continuous contact with at least a portion of an edge of the first opening of the corner cover and at least a portion of the first end of the second rail cover maintains continuous contact with at least a portion of an edge of the second opening of the corner cover.

2. The corner assembly of claim 1, wherein the corner cover is formed of a front cover section and a rear cover section attached around the side post of the foldable child enclosure.

3. The corner assembly of claim 2, wherein the front cover section and the rear cover section are integrally molded.

4. The corner assembly of claim 1, wherein the first rail cover and the second rail cover are each formed from a front cover and a rear cover attached around the first upper arm and the second upper arm, respectively.

5. The corner assembly of claim 1, wherein the corner assembly covers a latching mechanism for locking the foldable child enclosure in the open position.

6. The corner assembly of claim 1, wherein a first end of the first rail cover is formed in a substantially ball-like shape that is concentric with the first opening of the corner cover.

7. The corner assembly of claim 1, wherein a first end of the second rail cover is formed in a substantially ball-like shape that is concentric with the second opening of the corner cover.

8. The corner assembly of claim 1, wherein the first rail cover and the second rail cover are positioned substantially perpendicularly to one another.

9. The corner assembly of claim 1, wherein the first rail cover and the second rail cover are configured to cover a latching mechanism when in the open position.

10. The corner assembly of claim 1, wherein a bottom portion of the corner cover is substantially open.

11. A foldable child structure comprising:

an upper assembly forming an upper portion of the structure;

a base assembly forming a lower portion of the structure;

a post extending from each corner of the upper assembly to a corner of the base assembly, thereby forming the structure;

at least one latching mechanism provided at each corner of the upper assembly extending from an upper portion of at least one of the posts to a portion of at least one of the arm assemblies; and a corner assembly provided at each corner of the upper assembly for covering the at least one latching mechanism, the corner assembly comprising: a corner cover attached to one of the posts of the foldable child structure; a first rail cover mating with a first opening in the corner cover; and a second rail cover mating with a second opening in the corner cover, wherein the first rail cover and the second rail cover move relative to the corner cover as the foldable child structure is moved from a folded position to an open position.

12. The foldable child enclosure of claim 11, wherein the corner cover is formed of a front cover section and a rear cover section attached around the side post of the foldable child enclosure.

13. The foldable child enclosure of claim 12, wherein the front cover section and the rear cover section are integrally molded.

14. The foldable child enclosure of claim 11, wherein the first rail cover and the second rail cover are each formed from a front cover and a rear cover attached around arms of the upper assembly.

15. The foldable child enclosure of claim 11, wherein a first end of the first rail cover is formed in a substantially ball-like shape that is concentric with the first opening of the corner cover.

16. The foldable child enclosure of claim 11, wherein a first end of the second rail cover is formed in a substantially ball-like shape that is concentric with the second opening of the corner cover.

17. The foldable child enclosure of claim 11, wherein the first rail cover and the second rail cover are positioned substantially perpendicularly to one another.

18. The foldable child enclosure of claim 11, wherein a bottom portion of the corner cover is substantially open.

19. A corner assembly for a foldable child enclosure comprising:

a central portion; and two side portions mating with opposed openings provided in the central portion, wherein the corner assembly covers at least one latching mechanism provided in upper corners of the foldable child enclosure and the two side portions each have an end that maintains continuous contact with at least a portion of an edge of the opposed openings as the foldable child enclosure is moved from a folded position to an open position and vice-versa.

20. The corner assembly of claim 19, wherein the at least one latching mechanism locks the foldable child enclosure in the open position.

* * * * *

UNITED STATES PATENT AND TRADEMARK OFFICE

CERTIFICATE OF CORRECTION

PATENT NO. : 8,955,175 B2
APPLICATION NO. : 13/610998
DATED : February 17, 2015
INVENTOR(S) : Elijah M. Wiegmann et al.

It is certified that error appears in the above-identified patent and that said Letters Patent is hereby corrected as shown below:

In the Claims

Column 6, Line 61, Claim 12, delete "enclosure" and insert -- structure --

Column 6, Line 65, Claim 13, delete "enclosure" and insert -- structure --

Column 7, Line 1, Claim 14, delete "enclosure" and insert -- structure --

Column 7, Line 5, Claim 15, delete "enclosure" and insert -- structure --

Column 7, Line 9, Claim 16, delete "enclosure" and insert -- structure --

Column 7, Line 13, Claim 17, delete "enclosure" and insert -- structure --

Column 7, Line 16, Claim 18, delete "enclosure" and insert -- structure --

Signed and Sealed this
Ninth Day of June, 2015

Michelle K. Lee

Michelle K. Lee
*Director of the United States Patent and Trademark Office*